US008274472B1

(12) United States Patent
Wang et al.

(10) Patent No.: US 8,274,472 B1
(45) Date of Patent: Sep. 25, 2012

(54) DRIVING METHODS FOR BISTABLE DISPLAYS

(75) Inventors: Wanheng Wang, Pleasanton, CA (US); Yajuan Chen, Fremont, CA (US); Robert Sprague, Saratoga, CA (US); Andrew Ho, Atherton, CA (US); Hongmei Zang, Sunnyvale, CA (US)

(73) Assignee: SiPix Imaging, Inc., Fremont, CA (US)

( * ) Notice: Subject to any disclaimer, the term of this patent is extended or adjusted under 35 U.S.C. 154(b) by 1122 days.

(21) Appl. No.: 12/046,197

(22) Filed: Mar. 11, 2008

Related U.S. Application Data

(60) Provisional application No. 60/894,419, filed on Mar. 12, 2007.

(51) Int. Cl.
*G09G 3/34* (2006.01)

(52) U.S. Cl. ..... 345/107

(58) Field of Classification Search ..... 345/107, 345/690; 359/245, 296; 430/32; 349/108
See application file for complete search history.

(56) References Cited

U.S. PATENT DOCUMENTS

| | | | |
|---|---|---|---|
| 3,612,758 | A | 10/1971 | Evans et al. |
| 4,972,099 | A | 11/1990 | Amano et al. |
| 5,266,937 | A | 11/1993 | DiSanto et al. |
| 5,272,477 | A | 12/1993 | Tashima et al. |
| 5,930,026 | A | 7/1999 | Jacobson et al. |
| 5,961,804 | A | 10/1999 | Jacobson et al. |
| 6,019,284 | A | 2/2000 | Freeman et al. |
| 6,639,580 | B1 | 10/2003 | Kishi et al. |
| 6,657,612 | B2 | 12/2003 | Machida et al. |
| 6,671,081 | B2 | 12/2003 | Kawai |
| 6,686,953 | B1 | 2/2004 | Holmes |
| 6,774,883 | B1 | 8/2004 | Muhlemann |
| 6,885,495 | B2 | 4/2005 | Liang et al. |
| 6,902,115 | B2 | 6/2005 | Graf et al. |
| 6,914,713 | B2 | 7/2005 | Chung et al. |
| 6,930,818 | B1 | 8/2005 | Liang et al. |
| 6,932,269 | B2 | 8/2005 | Sueyoshi et al. |
| 6,950,220 | B2 | 9/2005 | Abramson et al. |

(Continued)

FOREIGN PATENT DOCUMENTS

| | | |
|---|---|---|
| JP | 03282691 | 12/1991 |

(Continued)

OTHER PUBLICATIONS

Kao, WC., Ye, JA., Chu, MI., and Su, CY. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.

(Continued)

*Primary Examiner* — Abbas Abdulselam
(74) *Attorney, Agent, or Firm* — Hickman Palermo Truong Becker Bingham Wong LLP

(57) ABSTRACT

Driving methods are described for display devices which have one or more dielectric layers in the path of an electric field driving the display. In an embodiment, image uniformity is improved by periodically refreshing, using an intermediate color state, pixels that remain in one color state before and after a change in displaying a first image and a second image, and by applying driving signals using voltage levels and durations that maintain a global DC balance in the display at near zero to avoid contrast reduction and image artifacts in the image.

12 Claims, 12 Drawing Sheets

U.S. PATENT DOCUMENTS

| | | | | |
|---|---|---|---|---|
| 6,995,550 | B2 | 2/2006 | Jacobson et al. | |
| 7,046,228 | B2 | 5/2006 | Liang et al. | |
| 7,177,066 | B2 | 2/2007 | Chung et al. | |
| 7,349,146 | B1 | 3/2008 | Douglass et al. | |
| 7,504,050 | B2 | 3/2009 | Weng et al. | |
| 7,626,444 | B2 | 12/2009 | Clewett et al. | |
| 7,733,311 | B2 | 6/2010 | Amundson et al. | |
| 7,800,580 | B2 * | 9/2010 | Johnson et al. | 345/107 |
| 7,839,381 | B2 | 11/2010 | Zhou et al. | |
| 7,999,787 | B2 * | 8/2011 | Amundson et al. | 345/108 |
| 8,035,611 | B2 * | 10/2011 | Sakamoto | 345/107 |
| 2002/0021483 | A1 | 2/2002 | Katase | |
| 2002/0033792 | A1 | 3/2002 | Inoue | |
| 2003/0011868 | A1 | 1/2003 | Zehner et al. | |
| 2003/0035885 | A1 | 2/2003 | Zang et al. | |
| 2003/0067666 | A1 | 4/2003 | Kawai | |
| 2003/0095090 | A1 | 5/2003 | Ham | |
| 2003/0137521 | A1 | 7/2003 | Zehner et al. | |
| 2003/0227451 | A1 | 12/2003 | Chang | |
| 2004/0112966 | A1 | 6/2004 | Pangaud | |
| 2004/0120024 | A1 | 6/2004 | Chen et al. | |
| 2004/0219306 | A1 | 11/2004 | Wang et al. | |
| 2004/0263450 | A1 | 12/2004 | Lee et al. | |
| 2005/0001812 | A1 | 1/2005 | Amundson et al. | |
| 2005/0162377 | A1 | 7/2005 | Zhou et al. | |
| 2005/0163940 | A1 | 7/2005 | Liang et al. | |
| 2005/0179642 | A1 | 8/2005 | Wilcox et al. | |
| 2005/0185003 | A1 | 8/2005 | Dedene et al. | |
| 2005/0219184 | A1 | 10/2005 | Zehner et al. | |
| 2006/0049263 | A1 | 3/2006 | Ou et al. | |
| 2006/0050361 | A1 | 3/2006 | Johnson | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0187186 | A1 | 8/2006 | Zhou et al. | |
| 2006/0209055 | A1 | 9/2006 | Wakita | |
| 2006/0238488 | A1 | 10/2006 | Nihei et al. | |
| 2006/0262147 | A1 | 11/2006 | Kimpe et al. | |
| 2007/0035510 | A1 | 2/2007 | Zhou et al. | |
| 2007/0046621 | A1 | 3/2007 | Suwabe et al. | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0091117 | A1 | 4/2007 | Zhou et al. | |
| 2007/0103427 | A1 | 5/2007 | Zhou et al. | |
| 2007/0146306 | A1 | 6/2007 | Johnson et al. | |
| 2007/0188439 | A1 | 8/2007 | Kimura et al. | |
| 2007/0262949 | A1 | 11/2007 | Zhou et al. | |
| 2007/0296690 | A1 | 12/2007 | Nagasaki | |
| 2008/0150886 | A1 | 6/2008 | Johnson et al. | |
| 2008/0303780 | A1 | 12/2008 | Sprague et al. | |
| 2009/0096745 | A1 | 4/2009 | Sprague et al. | |
| 2009/0267970 | A1 | 10/2009 | Wong et al. | |
| 2010/0134538 | A1 | 6/2010 | Sprague et al. | |
| 2010/0194733 | A1 | 8/2010 | Lin et al. | |
| 2010/0194789 | A1 | 8/2010 | Lin et al. | |
| 2010/0283804 | A1 | 11/2010 | Sprague et al. | |
| 2010/0295880 | A1 | 11/2010 | Sprague et al. | |
| 2011/0096104 | A1 | 4/2011 | Sprague et al. | |
| 2011/0175945 | A1 | 7/2011 | Lin | |
| 2011/0216104 | A1 | 9/2011 | Chan et al. | |

FOREIGN PATENT DOCUMENTS

| | | | |
|---|---|---|---|
| JP | 2000-336641 | | 1/2002 |
| KR | 1020090129191 | A1 | 12/2009 |
| WO | WO 01/67170 | | 9/2001 |
| WO | WO 2005004099 | A1 | 1/2005 |
| WO | WO 2005031688 | A1 | 4/2005 |
| WO | WO2005034076 | A1 | 4/2005 |
| WO | WO 2009/049204 | | 4/2009 |
| WO | WO 2010/132272 | | 11/2010 |

OTHER PUBLICATIONS

Kao, WC., (Feb. 2009) Configurable Timing Controller Design for Active Matrix Electrophoretic Display. *IEEE Transactions on Consumer Electronics*, 2009, vol. 55, Issue 1, pp. 1-5.

Kao, WC., Ye, JA., and Lin, C. (Jan. 2009) Image Quality Improvement for Electrophoretic Displays by Combining Contrast Enhancement and Halftoning Techniques. *ICCE 2009 Digest of Technical Papers*, 11.2-2, 2 pgs.

Kao, WC., Ye, JA., Lin, FS., Lin, C., and Sprague, R. (Jan 2009) Configurable Timing Controller Design for Active Matrix Electrophoretic Display with 16 Gray Levels. *ICCE 2009 Digest of Technical Papers*, 10.2-2, 2 pgs.

Kao, WC., Fang, CY., Chen, YY., Shen, MH., and Wong, J. (Jan. 2008) Integrating Flexible Electrophoreetic Display and One-Time Password Generator in Smart Cards. *ICCE 2008 Digest of Technical Papers*, P4-3. (Int'l Conference on Consumer Electronics, Jan. 9-13, 2008), 2 pgs.

Korean Patent Office, "International Search Report * Written Opinion", dated Dec. 7, 2010, application No. PCT/US2010/033906, 9 pages.

Current Claims for Korean application No. PCT/US2010/033906, 1 page.

U.S. Appl. No. 13/289,403, filed Nov. 4, 2011, Lin et al.

Allen, K. (Oct. 2003). Electrophoretics Fulfilled. Emerging Displays Review: Emerging Display Technologies, Monthly Report—Octomber 2003, 9-14.

Bardsley, J.N. et al. (Nov. 2004) Microcup™ Electrophoretic Displays. USDC Flexible Display Report, 3.1.2. pp. 3-12-3-16.

Chaug, Y.S. et al. (Apr. 2004). Roll-to-Roll Processes for the Manufacturing of Patterned Conductive Electrodes on Flexible Substrates. Mat. Res. Soc. Symp. Proc., vol. 814. I9.6.1.

Chen, S.M. (Jul. 2003) The Applications for the Revolutionary Electronic Paper Technology. OPTO News & Letters, 102, 37-41. (in Chinese, English abstract).

Chen, S.M. (May 2003) The New Application and the Dynamics of Companies. TRI. 1-10. (in Chinese, English abstract).

Chung, J. et al. (Dec. 2003). Microcup® Electrophoretic Displays, Grayscale and Color Rendition. IDW, AMD2/EP1-2, 243-246.

Ho, A. (Nov. 2006) Embedding e-Paper in Smart Cards, Pricing Labels & Indicators. Presentation conducted at Smart Paper Conference Nov. 15-16, 2006, Atlanta, GA.

Ho, Candice. (Feb. 1, 2005) Microcupt® Electronic Paper Device and Applicaiton. Presentation conducted at USDC 4th Annual Flexible Display Conference 2005, 36 pages.

Ho, C. et al. (Dec. 2003). Microcup® Electronic Paper by Roll-to-Roll Manufacturing Processes. Presentation conducted at FEG, Nei-Li, Taiwan, 36 pages.

Hopper, et al. (1979) An Electrophoretic Display, Its Properties, Model and Addressing. IEEE Trans. Electr. Dev., ED 26, No. 8, pp. 1148-1152.

Hou, J. et al. (May 2004). Reliability and Performance of Flexible Electrophoretic Displays by Roll-to-Roll Manufacturing Processes. SID Digest, 32.3, 1066-1069.

Howard, R. (Feb. 2004) Better Displays with Organic Films. Scientific American, pp. 76-81.

Kishi, et al., Development of In-plane EPD, SID 2000 Digest, pp. 24-27.

Lee, H. et al. (Jun. 2003) SiPix Microcup® Electronic Paper—An Introduction. Advanced Display, Issue 37, 4-9 (in Chinese, English abstract).

Liang, R. (Feb. 2003) Microcup® Electrophoretic and Liquid Crystal Displays by Roll-to-Roll Manufacturing Processes. Presentation conducted at the Flexible Microelectronics & Displays Conference of U.S. Display Consortium, Phoenix, Arizona, USA, 18 pages.

Liang, R. (Apr. 2004). Microcup Electronic Paper by Roll-to-Roll Manufacturing Process. Presentation at the Flexible Displays & Electronics 2004 of Intertech, San Fransisco, California, USA, 26 pages.

Liang, R. (Oct. 2004) Flexible and Roll-able Displays/Electronic Paper—A Technology Overview. Paper presented at the METS 2004 Conference in Taipei, Taiwan, 27 pages.

Liang, R. et al. (2003). Microcup® Active and Passive Matrix Electrophoretic Displays by a Roll-to-Roll Manufacturing Processes. SID Digest, 20.1, 4 pages.

Liang, R. et al. (Dec. 2002) Microcup Electrophoretic Displays by Roll-to-Roll Manufacturing Processes. IDW , EP2-2, 1337-1340.

Liang, R. et al. (Feb. 2003). Passive Matrix Microcup® Electrophoretic Displays. Paper presented at the IDMC, Taipei, Taiwan, 4 pages.
Liang, R. et al. (2003). Microcup® displays : Electronic Paper by Roll-to-Roll Manufacturing Processes. Journal of the SID, 11(4), 621-628.
Liang, R. et al. (Jun./Jul. 2004) Format Flexible Microcup® Electronic Paper by Roll-to-Roll Manufacturing Process , Presentation conducted at the 14th FPD Manufacturing Technology EXPO & Conference, 44 pages.
Liang, R. et al. (Feb. 2003). Microcup® LCD, A New Type of Dispersed LCD by a Roll-to-Roll Manufacturing Process. Paper presented at the IDMC, Taipei, Taiwan, 4 pages.
Liang, R. Nikkei Microdevices. (Dec. 2002) Newly-Developed Color Electronic Paper Promises—Unbeatable Production Efficiency. Nikkei Microdevices, p. 3. (in Japanese, with English translation) 4 pages.
Swanson, et al., High Performance EPDs, SID 2000, pp. 29-31.
Wang, X. et al. (Feb. 2004). Mirocup® Electronic Paper and the Converting Processes. ASID, 10.1.2-26, 396-399, Nanjing, China.
Wang, X. et al. (Jun. 2004) Microcup® Electronic Paper and the Converting Processes. Advanced Display, Issue 43, 48-51 (in Chinese, with English abstract).
Wang, X. et al. (Feb. 2006) Inkjet Fabrication of Multi-Color Microcup® Electrophorectic Display. The Flexible Microelectronics & Displays Conference of U.S. Display Consortium, 11 pages.
Wang, X. et al. (Jun. 2006) Roll-to-Roll Manufacturing Process for Full Color Electrophoretic film. SID 2006 Digest, pp. 1587-1589.
Zang, H. (Feb. 2004). Microcup Electronic Paper. Presentation conducted at the Displays & Microelectronics Conference of U.S. Display Consortium, Phoenix, Arizona, USA, 14 pages.
Zang, H. (Oct. 2003). Microcup® Electronic Paper by Roll-to-Roll Manufacturing Processes. Presentation conducted at the Advisory Board Meeting, Bowling Green State University, Ohio, USA, 18 pages.
Zang, H. et al. (Feb. 2005) Flexible Microcup® EPD by RTR Process. Presentation conducted at 2nd Annual Paper-Like Displays Conference, Feb. 9-11, 2005, St. Pete Beach, Florida, 26 pages.
Zang, H. et al. (2003) Microcup Electronic Paper by Roll-to-Roll Manufacturing Processes. The Spectrum, 16(2), 16-21.
Zang, H. et al. (Jan. 2004). Threshold and Grayscale Stability of Microcup® Electronic Paper. Proceeding of SPIE—IS&T Electronic Imaging, SPIE vol. 5289, 102-108.
Zang, H. et al. (May 2006) Monochrome and Area Color Microcup® EPDs by Roll-to-Roll Manufacturing Processes. ICIS ' 06 International Congress of Imaging Science Final Program and Proceedings, pp. 362-365.
U.S. Appl. No. 12/046,197, filed Mar. 11, 2008, Wang et al.
U.S. Appl. No. 12/155,513, filed May 5, 2008, Sprague et al.
U.S. Appl. No. 13/004,763, filed Jan. 11, 2011, Lin et al.
U.S. Appl. No. 13/152,140, filed Jun. 2, 2011, Lin.
Sprague, R.A. "Active Matrix Displays for e-Readers Using Microcup Electrophoretics". Presentation conducted at SID 2011, 49 International Symposium Seminar and Exhibition, dated May 18, 2011, 20 pages.
U.S. Appl. No. 12/115,513, filed Feb. 16, 2012, Notice of allowance, Feb. 16, 2012.
U.S. Appl. No. 12/132,238, filed Jun. 3, 2008, Office Action, Nov. 9, 2011.
U.S. Appl. No. 11/607,757, filed Nov. 30, 2006, Final Office Action, Mailed Apr. 6, 2012.
U.S. Appl. No. 12/772,330, filed May 3, 2010, Office Action, Mailed Apr. 16, 2012.
U.S. Appl. No. 12/132,238, filed Jun. 3, 2008, Final Office Action, Mailed May 1, 2012.
Final Office Action dated Feb. 28, 2010 in related U.S. Appl. No. 11/607,757, filed Nov. 30, 2005.
Final Office Action dated Oct. 13, 2010 in related U.S. Appl. No. 11/636,407, filed Dec. 7, 2006.
Office Action dated Aug. 17, 2010 in related U.S. Appl. No. 11/972,150, filed Jan. 10, 2008.
Final Office Action dated Dec. 3, 2010 in related U.S. Appl. No. 11/972,150, filed Jan. 10, 2008.
Office Action dated Jan. 20, 2011 in related U.S. Appl. No. 11/636,407, filed Dec. 7, 2006.
Office Action dated Mar. 22, 2011 in related U.S. Appl. No. 11/972,150, filed Jan. 10, 2008.
Office Action dated May 10, 2011 in related U.S. Appl. No. 12/115,513, filed May 5, 2008.
Notice of Allowance dated Jun. 2, 2011 in related U.S. Appl. No. 11/972,150, filed Jan. 10, 2008.
Final Office Action dated Jun. 3, 2011 in related U.S. Appl. No. 11/636,407, filed Dec. 7, 2006.
Office Action dated Jul. 21, 2011 in related U.S. Appl. No. 12/115,513, filed May 5, 2008.
Office Action dated Sep. 7, 2011 in related U.S. Appl. No. 11/607,757 filed Nov. 30, 2006.
Liang, R. Flexible and Roll-able Displays/Electronic Paper—A Brief Technology Overview. Flexible Display Forum (Feb. 2005) Taiwan, 27 pages.

* cited by examiner

DRIVING METHODS FOR BISTABLE DISPLAYS

BENEFIT CLAIM

This application claims the benefit under 35 U.S.C. 119(e) of prior provisional application 60/894,419, filed Mar. 12, 2007, the entire contents of which are hereby incorporated by reference as if fully set forth herein.

TECHNICAL FIELD

The present disclosure relates to an electrophoretic display, and more specifically, to driving methods for an electrophoretic display.

BACKGROUND

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

The electrophoretic display (EPD) is a non-emissive device based on the electrophoresis phenomenon of charged pigment particles suspended in a solvent. The display usually comprises two plates with electrodes placed opposing each other, separated by using spacers. One of the electrodes is usually transparent. A suspension composed of a colored solvent and charged pigment particles is enclosed between the two plates. When a voltage difference is imposed between the two electrodes, the pigment particles migrate to one side and then either the color of the pigment particles or the color of the solvent can be seen according to the polarity of the voltage difference.

There are several different types of EPDs, such as the conventional type EPD, or the microcapsule-based EPD or EPD with electrophoretic cells that are formed from parallel line reservoirs. EPDs comprising closed cells formed from microcups filled with an electrophoretic fluid and sealed with a polymeric sealing layer are disclosed U.S. Pat. No. 6,930,818, the content of which is incorporated herein by reference in its entirety for all purposes as if fully disclosed herein.

An EPD may be driven by a uni-polar or bi-polar approach. Under a uni-polar approach, the pixels in a display device are driven to their destined states in two consecutive driving phases. In phase one, selected pixels are driven to a first color state and in phase two, the remaining pixels are driven to a second color state that contrasts with the first color state. For example, in phase one, selected pixels may be driven to a first display state in which the charged pigment particles in the dispersion layer are at or near the non-viewing side of the display device, and in phase two, the remaining pixels are then driven to a second display state in which the charged pigment particles are at or near the viewing side of the display device. Alternatively, the charged pigment particles of selected pixels may first be driven to at or near the viewing side of the display device and the charged pigment particles of the remaining pixels may then be driven to at or near the non-viewing side.

Under a bipolar approach, a driving biasing voltage of a first polarity drives selected pixels to a first display state, and a second biasing voltage of the opposite polarity drives the remaining pixels at the same time to a second state to form a display pattern or image. For example, a positive bias voltage may be applied to the pixels so that a state in which the charged pigment particles are at or near the viewing side of the display device is reached and a negative bias voltage is simultaneously applied to the remaining pixels so that the charged pigment particles are at or near the non-viewing side of the display device.

The bipolar approach tends to be faster than the uni-polar approach, but the electronic drivers used in the bipolar approach tend to be more costly because of their bipolar nature. In either case, the selection of detailed waveform characteristics for driving electrophoretic displays is based on a number of features. For example, if the DC balance, or average voltage applied across the display material is zero when integrated over a substantial time period, the display contrast may be improved and ghost images may be reduced. In addition, if the color or display state of a pixel remains unchanged in consecutive images, the charged pigment particles in that pixel do not get refreshed during transition between the images. As a result, the image uniformity may deteriorate after a period of time, if the display does not have good bi-stability (i.e., maintaining images without power). Driving methods for a bistable display thus must be carefully selected to deal with these phenomena.

SUMMARY OF THE DISCLOSURE

The present disclosure is directed to driving methods for bistable displays.

A first aspect is directed to driving methods which allow refreshing of the pixels during transition of images and simultaneously maintaining the global DC balance without increasing the total driving time.

In this aspect, one embodiment is directed to a driving method for an electrophoretic display capable of displaying at least two color states, a first color state and a second color state which is in contrast with the first color state. Such a method comprises applying a driving signal to a class of pixels which are in substantially the same color state (the first color state or the second color state) in consecutive display images to cause the pixels to display an intermediate color state during transition between the consecutive display images.

The term "intermediate color state", in the context of the present disclosure, is a mid-tone color between the first and second color states or a composite color of the first and second color states. The term "intermediate color state" is also defined as a color state in which its optical density has a change ($\Delta D$) of at least 0.01 from either the first color state or the second color state. Alternatively, $\Delta D$ may be at least 0.03.

To achieve a $\Delta D$ of at least 0.01, a relatively shorter driving signal is applied. For example, for a driving signal of 40 volts and a display device in which the display cells (e.g., microcups) have a cell gap (i.e., the distance between the top and bottom electrode layers, 11 and 12 in FIG. 1) of about 24 microns, the duration of the driving signal may be somewhere in the range of about 0.15 to 0.40 seconds. Alternatively, the level of voltage may be set to an intermediate level to achieve a similar result.

The perceived intensity of the intermediate color state is determined by the intensity of the voltage applied and/or the duration of the voltage applied, since the display may not switch states fully during a short duration pulse and the eye may not fully resolve to the states displayed due to its response time.

In this same method, other pixels may change from one color state (i.e., the first color state) in one display image to the other color state (i.e., the second color state) in the next display image, without going through an intermediate color state.

A second aspect is directed to the driving methods which allow refreshing of the pixels when there is no change of the image displayed.

In this, one embodiment is directed to a driving method which comprises applying a driving signal to a class of pixels to cause the pixels to change from an original color state to an intermediate color state and then back to the original color state. Because the driving signal is of a short duration, the intermediate color state is barely detectable by the naked eyes. Therefore from a viewer's point, the image displayed is not altered and the intermediate color state is hardly noticeable. In another embodiment, a driving signal is applied to a first class of pixels to cause them to change from an original color state to an intermediate color state and then back to the original color state and a second driving signal is applied to a second class of pixels to cause them to change from an original color state to an intermediate color state and then back to the original color state, without changing images displayed. The first and second driving signals may be applied at the same time or at different times. The intensities of the first and second driving signals may be the same or different. The term of an "intermediate color state" is as defined above.

The methods may be applied by a uni-polar or bipolar approach.

The driving methods described herein are particularly suitable for display devices which have one or more dielectric layers in the path of an electric field driving the display.

The driving methods described herein can be adapted to a display device which is capable of displaying more than two color states, such as a dual mode display device as described in U.S. Pat. No. 7,046,228, the content of which is incorporated herein by reference in its entirety for all purposes as if fully set forth herein.

DETAILED DESCRIPTION

A detailed description of the driving methods is provided below with figures that illustrate by way of examples. While the invention is described in connection with these examples, it should be understood that the invention is not limited to any of the exemplified methods. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

1.0 Context for Embodiments

1.1 Electrophoretic Display Structure

Figure 1:
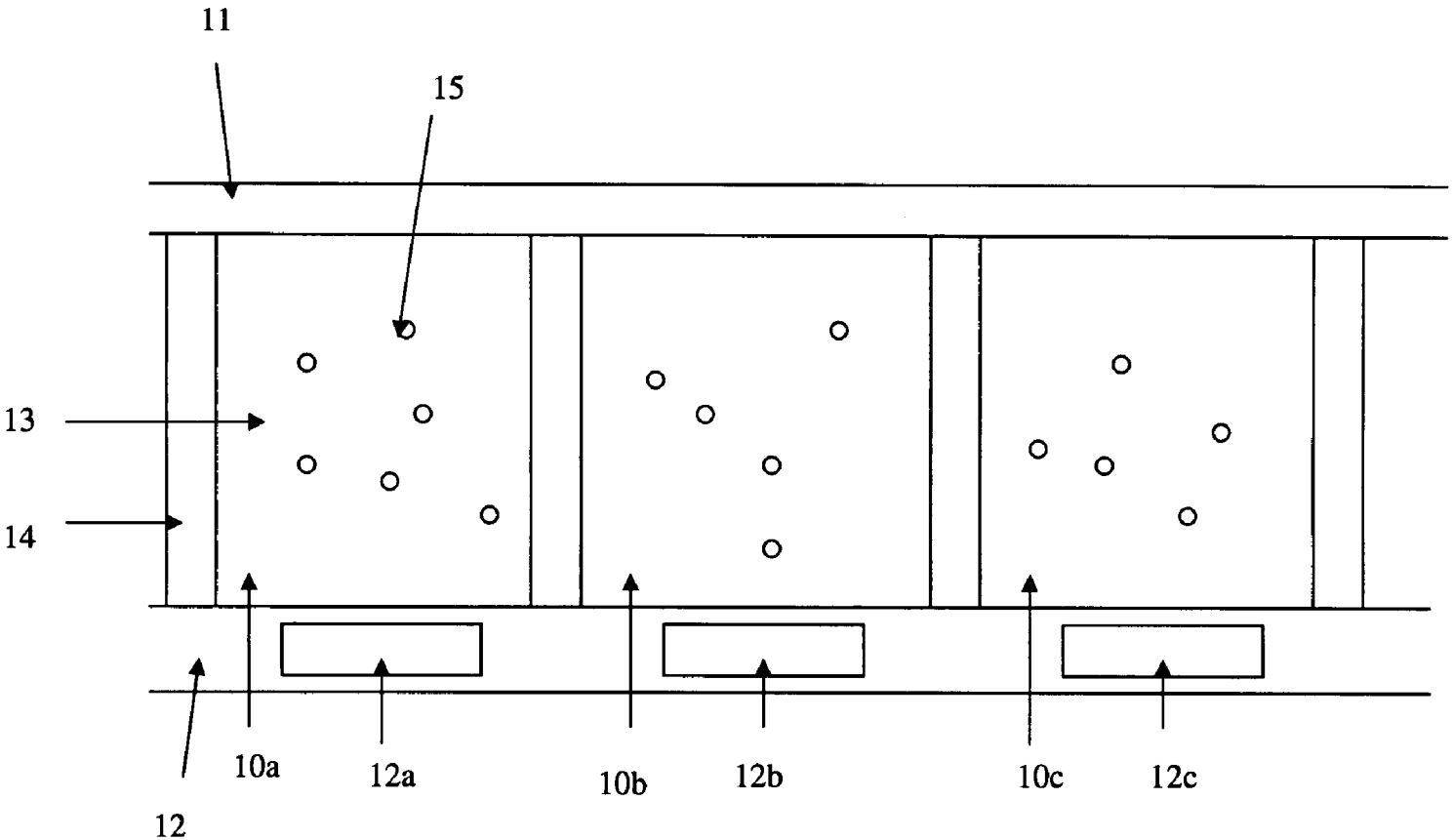
FIG. 1 is a cross-section view of a display device.

FIG. 1 illustrates an array of display cells (10*a*, 10*b* and 10*c*) in an electrophoretic display which may be driven by the driving methods of the present disclosure. In the figure, the display cells are provided, on the front or viewing side (top surface as illustrated in FIG. 1) with a common electrode 11 (which usually is transparent) and on the rear side with a substrate 12 carrying a matrix of discrete pixel electrodes (12*a*, 12*b* and 12*c*). Each of the discrete pixel electrodes 12*a*, 12*b* and 12*c* defines a pixel of the display. An electrophoretic fluid (13) is filled in each of the display cells.

For ease of illustration, FIG. 1 shows only a single display cell associated with a discrete pixel electrode, although in practice a plurality of display cells (as a pixel) may be associated with each discrete pixel electrode. The electrodes may be segmented in nature rather than pixellated, defining regions of the image instead of individual pixels. Therefore while the term "pixel" or "pixels" is frequently used in this description to illustrate the driving methods of the disclosure, it is understood that the driving methods are applicable to not only pixellated display devices, but also segmented display devices.

Each of the display cells is surrounded by display cell walls 14. For ease of illustration of the methods described below, the electrophoretic fluid is assumed to comprise white charged pigment particles (15) dispersed in a dark color solvent and the particles 15 are positively charged so that they will be drawn to the discrete pixel electrode or the common electrode, whichever is at a lower potential.

The driving methods herein also may be applied to particles (15) in an electrophoretic fluid which are negatively charged. Also, the particles could be dark in color and the solvent light in color so long as sufficient color contrast occurs as the particles move between the front and rear sides of the display cell. The display could also be made with a transparent or lightly colored solvent with particles of two different colors and carrying opposite charges.

The display cells may comprise partition type display cells, microcapsule-based display cells or microcup-based display cells. In microcup-based display cells, the filled display cells may be sealed with a sealing layer (not shown in FIG. 1). There may also be an adhesive layer (not shown) between the display cells and the common electrode.

1.2 Uni-Polar Driving Method

Figure 2:
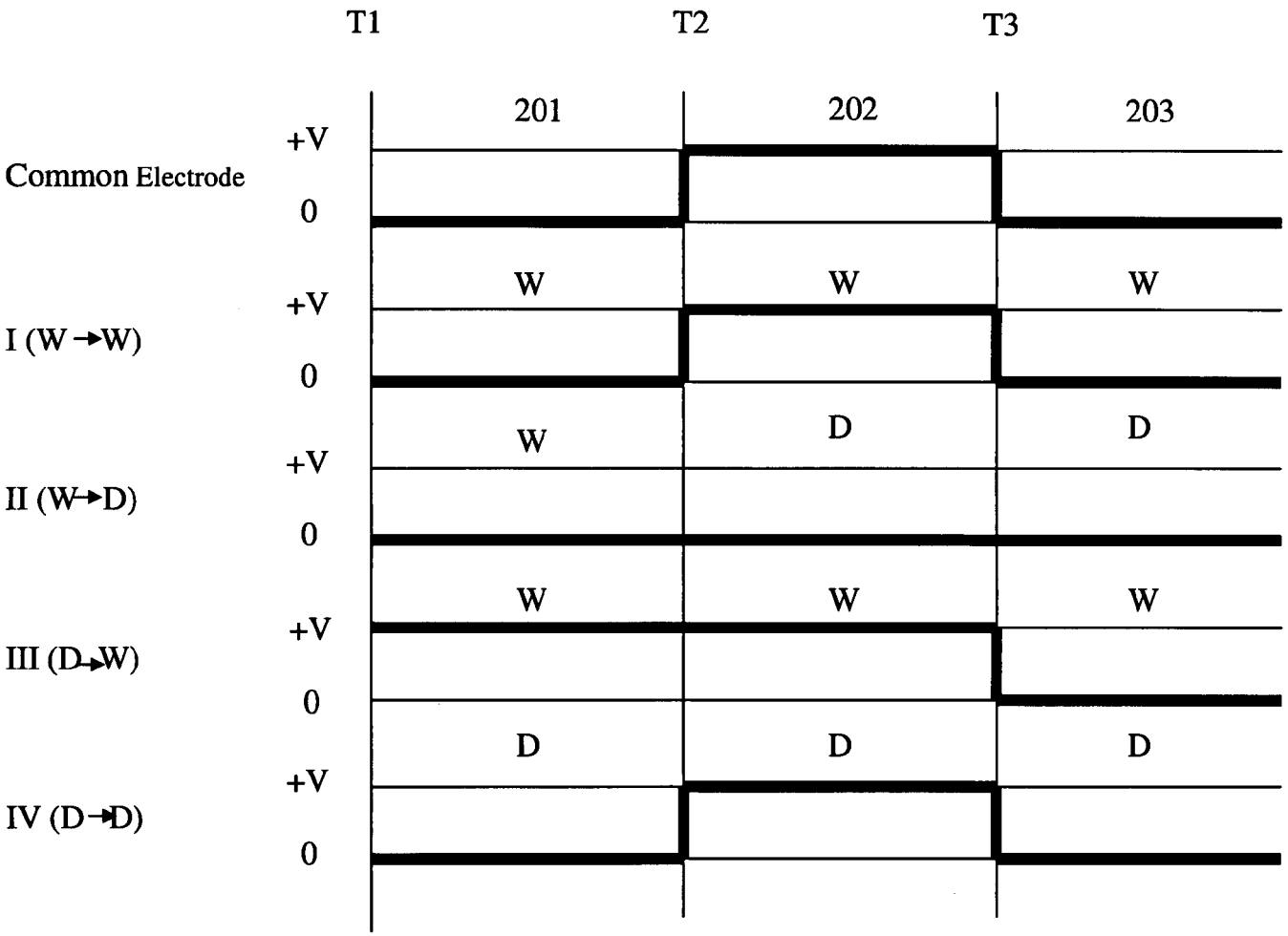
FIG. 2 depicts a uni-polar approach for driving an electrophoretic display.

FIG. 2 shows a uni-polar driving method. The driving method comprises one driving cycle (from T1-T3) and a resting cycle (from T3 to the start of next driving cycle). In the resting cycle, the display is not being driven (i.e., no voltage is applied). The top waveform represents the voltages applied to the common electrode in a display device. The four waveforms below (I, II, III and IV) represent how pixels in the display device may be driven from "white to white", "white to dark", "dark to white" and "dark to dark", respectively. The initial color, white or dark, of a pixel is the color of the pixel before the driving method is applied.

The voltage for the common electrode is set to 0 in driving frame 201 (T1-T2) and is switched to +V in driving frame 202 (T2-T3).

For a white pixel to be maintained in the white state in the next image (i.e., waveform I), the voltage is also set to 0 in driving frame 201 and switched to +V in driving frame 202. In both the driving and resting cycles, the pixel remains in the white state.

For a white pixel to change to the dark state in the next image (i.e., waveform II), the voltage is set to 0 initially in driving frame 201 and maintained at 0 in driving frame 202. In this driving method, the pixel turns to the dark state in driving frame 202 and remains in the dark state in the resting cycle.

For a dark pixel to change to the white state in the next image (i.e., waveform III), a voltage of +V is applied in driving frame 201 and maintained in driving frame 202. In this driving method, the pixel turns white in driving frame 201 and remains white through out the driving and resting cycles.

For a dark pixel to be maintained in the dark state in the next image (i.e., waveform IV), the voltage is set to zero in driving frame 201 and switched to +V in driving frame 202. In this driving method, the pixel remains dark through out the driving and resting cycles.

This driving method has a potential problem, namely that image uniformity may worsen over time because the pigment particles are not refreshed when the color of the pixels remains unchanged in consecutive display images. Refreshing refers to driving pigment particles to an opposite state and then restoring the prior state, so that the pigment particles are reordered and rearranged and potentially different pigment particles are driven to different locations. In addition, it is important to maintain the global DC balance, or longer term average voltage, across the display medium, at near zero to avoid contrast reduction and image artifacts in the image. This may be accomplished by waveforms through the natural averaging of plus and minus voltage terms over sequential cycles of the image as pixels turn from one image state to the other and back. For purposes of illustrating a clear example, only one image cycle is shown herein.

2.0 Periodic Refreshing Approaches

The approach herein is directed to driving methods in which the pixels are periodically refreshed to eliminate the problem associated with the foregoing driving method.

The driving methods described herein are applicable to an electrophoretic display which is capable of displaying at least two color states, a first color state and a second color state which is in contrast with the first color state. In various embodiments, a driving signal is applied to a class of pixels which are in substantially the same color state (the first color state or the second color state) in consecutive display images to cause the pixels to display an intermediate color during transition between the consecutive display images. The intensity of the intermediate color state is determined by the magnitude and the duration of the driving signal applied to the pixels.

The pixels which change its color state (from the first color state to the second color state or vice versa), in these driving methods, may not go through an intermediate color state.

Figure 3:
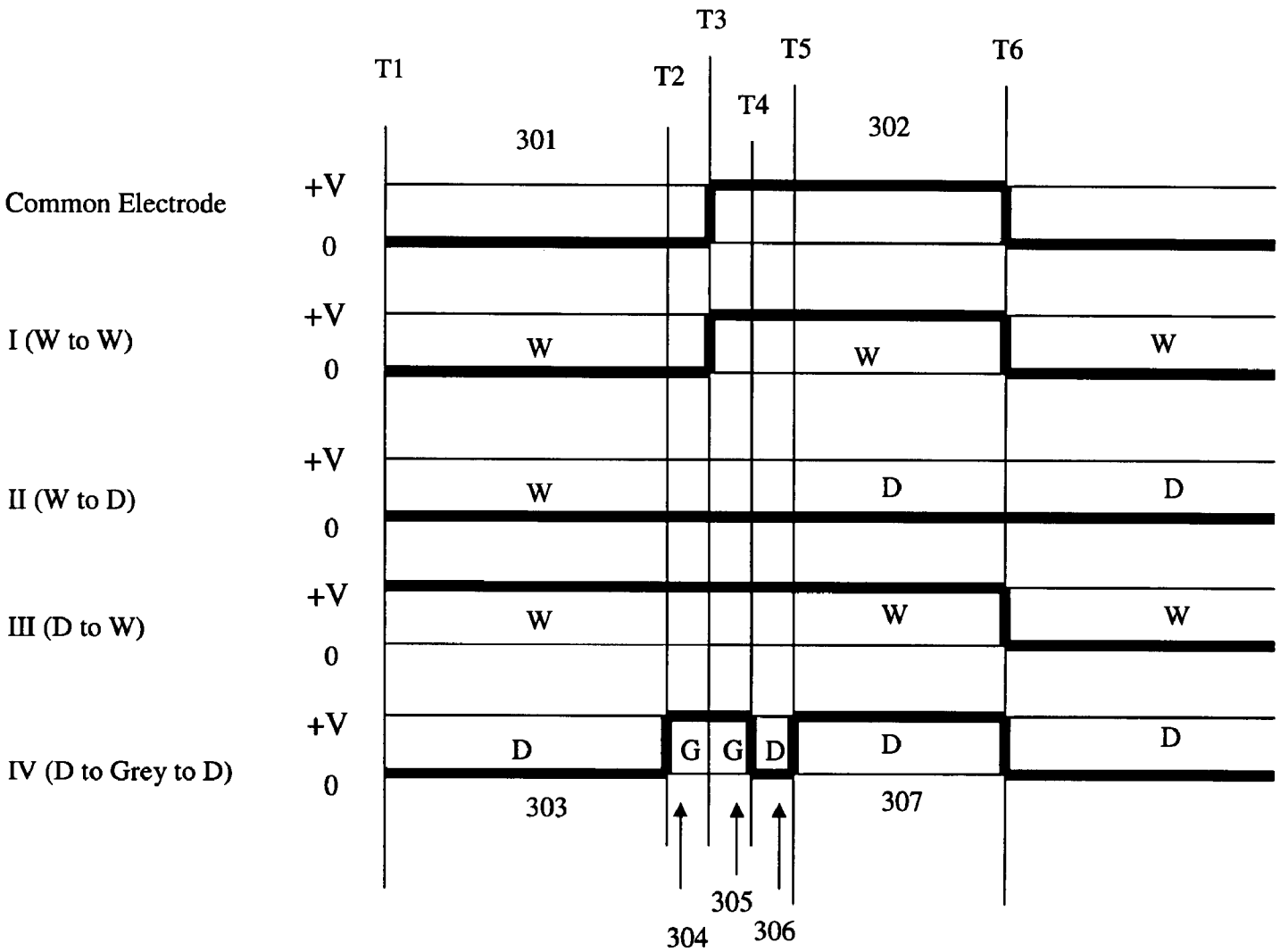
FIG. 3 illustrates a driving method for driving an electrophoretic display.

A first example driving method is illustrated in FIG. 3. The driving method shown in the figure comprises one driving cycle (from T1 to T6) and a resting cycle (from T6 to the start of the next driving cycle). In the resting cycle, the display is not being driven (i.e., no voltage or zero bias voltage is applied). The top waveform represents the voltages applied to the common electrode. The four waveforms, I, II, III and IV, represent how pixels in the display device may be driven from "white to white", "white to dark", "dark to white," and "dark to grey to dark" respectively. The initial color, white or dark, of a pixel is the color of the pixel before the driving starts.

The voltage for the common electrode is set to 0 in driving frame 301 (T1-T3) and is switched to +V in driving frame 302 (T3-T6).

For a white pixel to be maintained in the white state (i.e., waveform I), the voltage is also set to 0 in driving frame 301 and switched to +V in driving frame 302. In both the driving and resting cycles, the pixel remains in the white state.

For a white pixel to change to the dark state (i.e., waveform II), the voltage is set to 0 initially in driving frame 301 and maintained at 0 in driving frame 302. In this driving cycle, the pixel turns to the dark state in driving frame 302 and remains in the dark state in the resting cycle.

For a dark pixel to change to the white state in the next image (i.e., waveform III), a voltage of +V is applied in driving frame 301 and maintained in driving frame 302. In this driving cycle, the pixel turns white in driving frame 301 and remains white throughout the driving and resting cycles.

For a dark pixel to be maintained in the dark state in the next image (i.e., waveform IV), the driving cycle is divided into multiple driving frames, 303 (T1-T2), 304 (T2-T3), 305 (T3-T4), 306 (T4-T5) and 307 (T5-T6). The multiple driving frames may be viewed as ordered from left to right as a first driving frame 303 followed by second and subsequent driving frames. Alternatively when a portion of the waveform is considered then a first portion such as driving frame 304 may be considered a first driving frame followed by a second driving frame 306 and a third driving frame 307. The same ordering and labeling applies to all other drawing figures in which multiple driving frames are represented.

In driving frame 303, the voltage is set to 0 which is raised to +V in driving frame 304. The duration of 304 is shorter than that of 303. The pixel turns from the dark state to a grey color when transitioned from driving frame 303 to driving frame 304.

Driving frame 305 is optional in practice, and if it is present, its duration may vary. The presence of driving frame 305 does not affect the global DC balance because the voltage sensed during this driving frame is substantially 0. Whether driving frame 305 is needed depends on the materials from which the display device is formed.

In driving frame 306, the voltage is switched to 0, thus turning the pixel to the dark state. After a short duration for driving frame 306, the voltage is raised to +V in driving frame 307.

In the driving scheme shown in FIG. 3, the duration of driving frame 304 and the duration of driving frame 306 are substantially equal in order to maintain the global DC balance. The duration of frames 304 and 306 depends on the properties of the display devices. Generally, after applying the two pulses, the optical density of the pixel should reach its optimal value.

Figure 6:
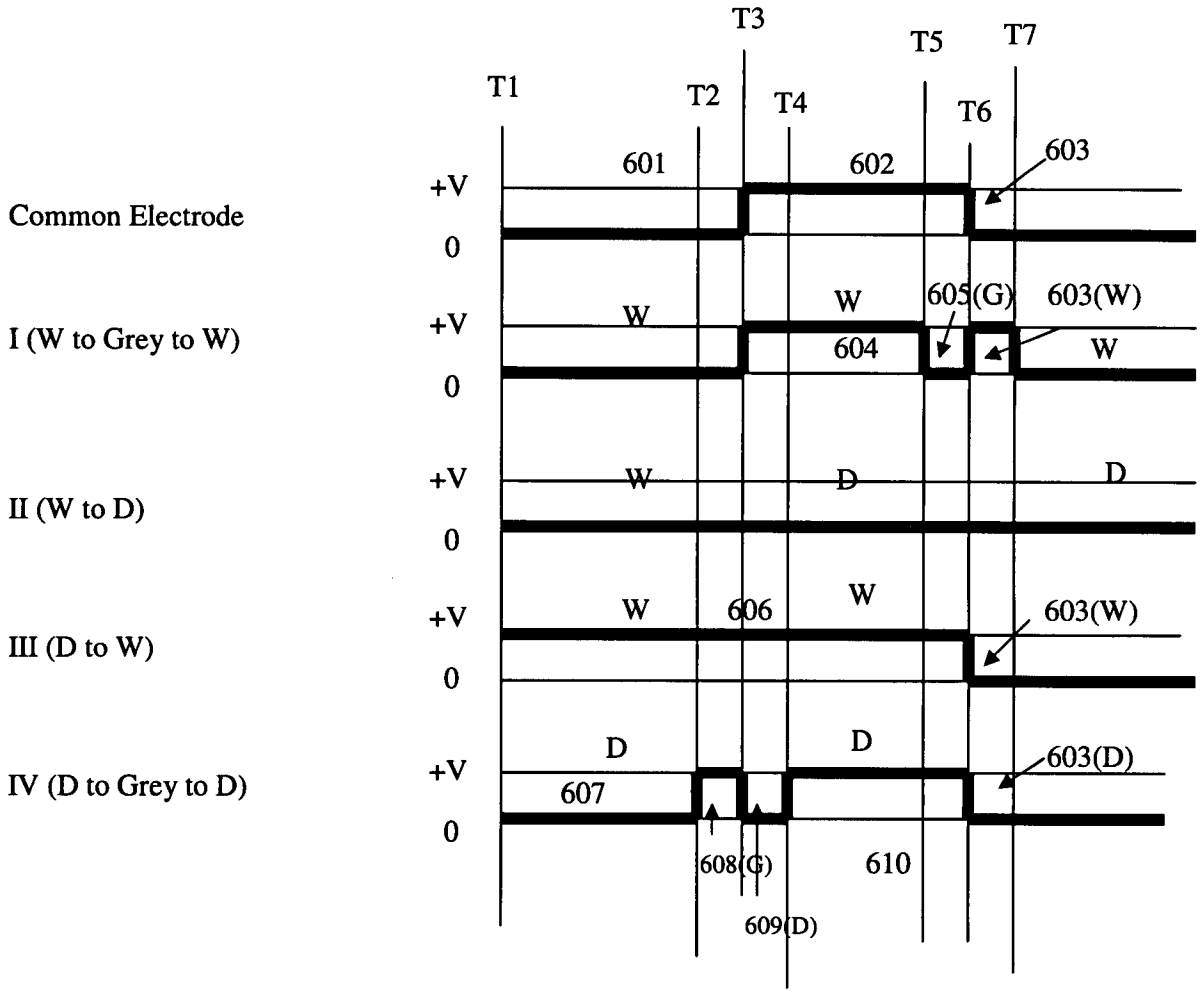
FIGS. 6 and 7 illustrate alternative driving methods.

While only the waveform for the "dark to dark" pixels is shown in FIG. 3 to have a gray intermediate state, a similar driving method may be applied to the "white to white" pixels (i.e., waveform I), as illustrated in FIG. 6, so that a grey transition occurs. In practice, the driving method may be implemented for the "dark to dark" transition only, the "white to white" transition only or for both transitions.

Figure 4:
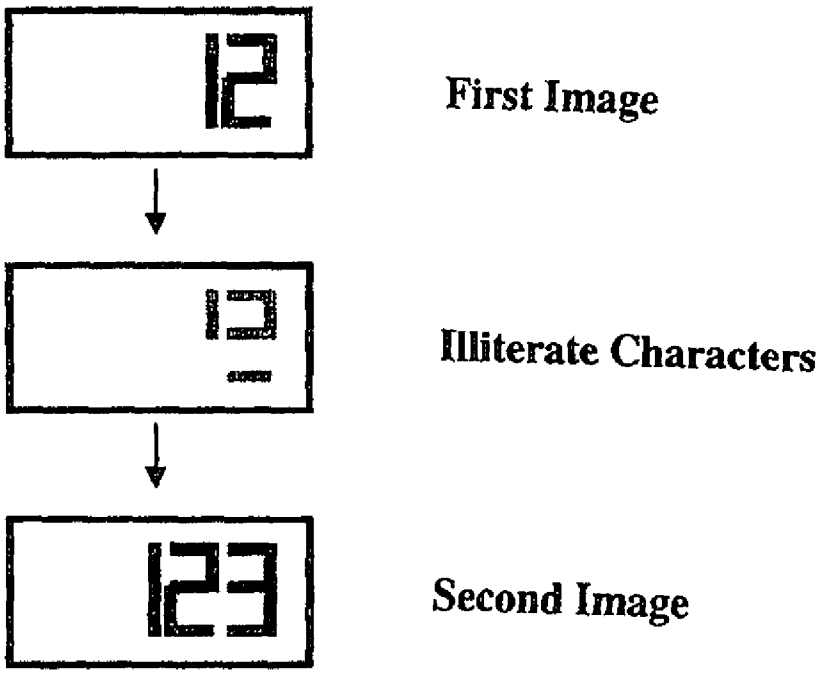
FIG. 4 is a practical example of the driving method of FIG. 3.

FIG. 4 is a practical example of the driving method of FIG. 3. As shown, the dark pixels which remain dark in the second image go through a transitional grey state during which an observer may perceive illiterate characters while the pixels in white initially may remain white or directly switch to the dark state (according to waveform I and II respectively) and the pixels of the dark state may directly switch to the white state (according to waveform III).

In this driving method, the division of the driving cycle (i.e., the locations of the driving frames 303-307) may vary and they can be selected to better reduce the visual effect of the illiterate characters by causing the intermediate display pattern to be dimmed. In other words, the reflectance of the color state of the illiterate characters is significantly different from that of the foreground; but close to the reflectance of the background during transition from the first image to the intermediate image.

In a display device, for example, a microcup-based display device, there are three dielectric layers: (a) the display cell layer and the substrate layer (12) in FIG. 1, if present, (b) the electrophoretic fluid layer (13) and (c) the sealing and adhesive layers, if present.

Figure 5A:
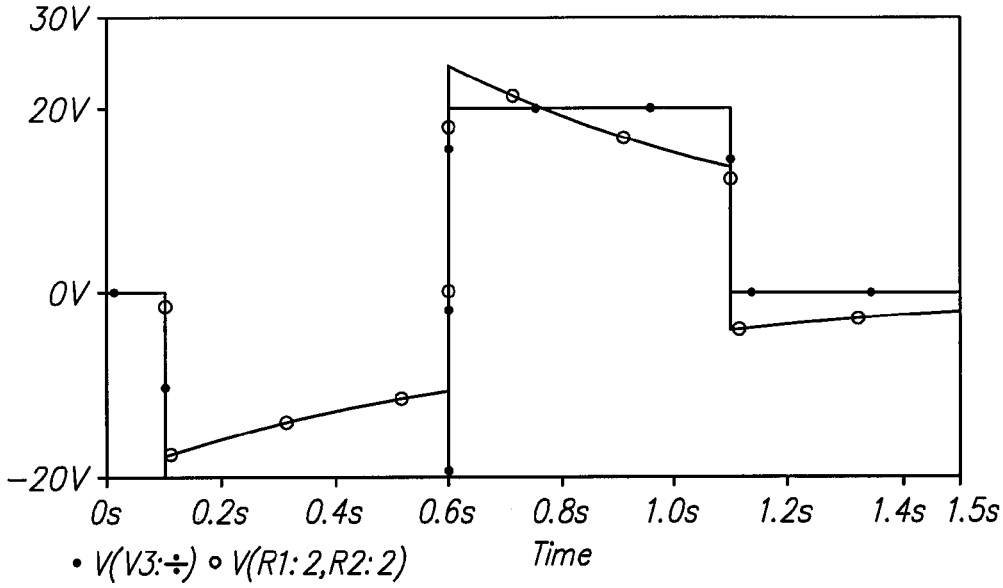
FIGS. 5*a* and 5*b* depict the "applied voltage vs. effective voltage" to show image enhancement for pixels.
Figure 5B:
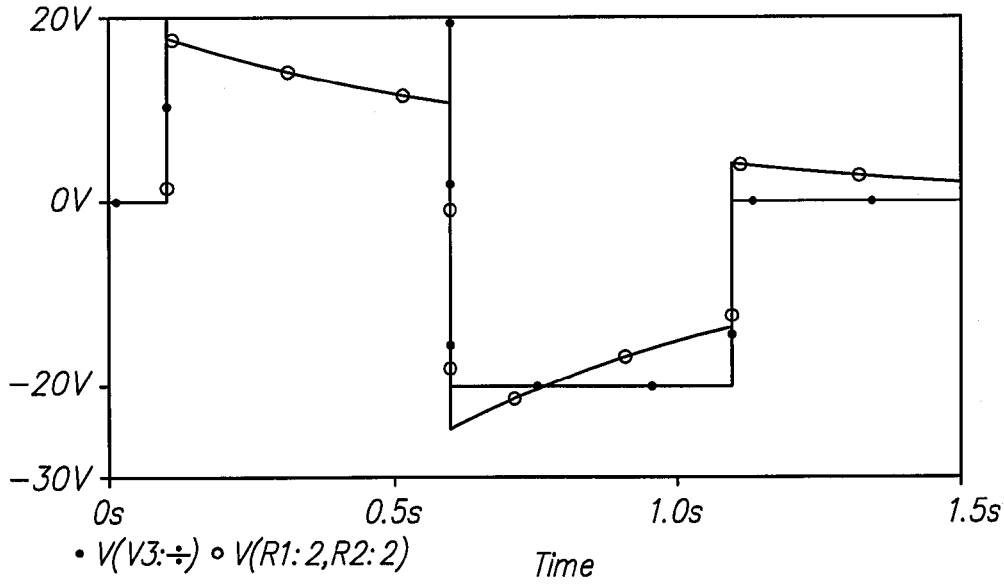
Figure 5C:
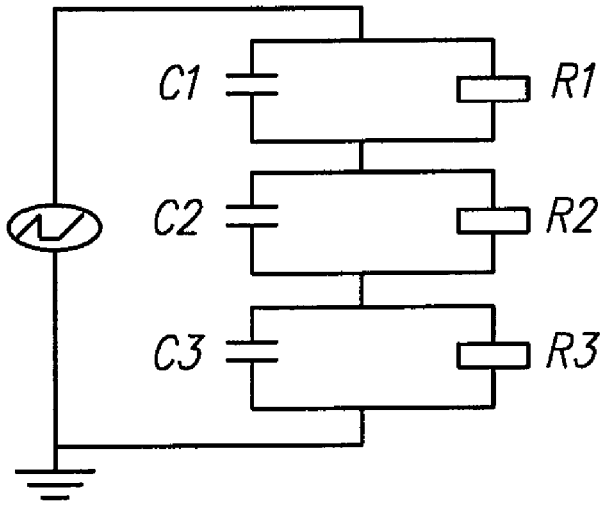
FIG. 5*c* depicts a simplified electrical equivalent circuit of the three dielectric layers in a display device.

FIG. 5*c* depicts a simplified electrical equivalent circuit of the three dielectric layers in such a display device. Specifically C1, C2 and C3 represent the electrical capacitance whereas R1, R2 and R3 represent the corresponding electrical resistance of the three dielectric layers. The driving method of FIG. 3 and other driving methods described in this disclosure are particularly suitable for a display device having such multiple dielectric layers.

FIG. 5*a* shows a simulated "applied voltage vs. effective voltage" graph for the displays with the same or similar structures as depicted in FIG. 5*c* to show the image enhancement of the white pixels. In FIG. 5*a*, solid lines denote the applied voltages and the dotted lines denote the effective voltages (i.e., the voltages sensed by the pigment particles in the electrophoretic fluid). As shown in the figure, to the white pixels, no voltage is initially applied, followed by a voltage difference of −20V and then +20V. The pigment particles in these pixels, in a period, sense a more intense voltage than the voltage actually applied, thus become more tightly packed, causing the image to be enhanced.

FIG. 5*b* shows a simulated "applied voltage vs. effective voltage" graph to show the image enhancement of the dark pixels. As shown, to the dark pixels, a voltage difference of +20 V is first applied, followed by a voltage difference of −20V. The pigment particles in the pixel become more tightly packed because they, in a period, sense a more intense voltage than the voltage actually applied. As a result, the image is enhanced.

The waveforms shown in FIGS. 5*a* and 5*b* can apply once or multiple times with or without a resting period (i.e., no voltage applied across the display medium) in between to enhance the current images without changing the image pattern.

FIG. 6 illustrates the application of the mechanism depicted in FIGS. 5*a* and 5*b* on the white to white and dark to dark pixels (i.e., waveform I and waveform IV). The driving method shown in FIG. 6 comprises one driving cycle (T1-T7) and a resting cycle (from T7 to the start of the next driving cycle). Similar to FIG. 3, the top wave form represents the voltages applied to the common electrode and the four waveforms, I, II, III and IV, represent how pixels in the display device may be driven from "white to white", "white to dark", "dark to white" and "dark to dark", respectively. The initial color, white or dark, of a pixel is the color displayed before the driving method starts.

The voltage for the common electrode is set to 0 in driving frame 601 (T1-T3), set to +V in driving frame 602 (T3-T6) and set to 0 again in driving frame 603 (T6-T7). The duration of drive frame 601 is substantially the same as that of frame 602.

For a white pixel to be maintained in the white state in the next image (i.e., waveform I), the driving cycle comprises four driving frames, 601 (T1-T3), 604 (T3-T5), 605 (T5-T6) and 603 (T6-T7). The voltages for the driving frames 601, 604, 605 and 603 are set to 0, +V, 0 and +V, respectively. The duration of frame 605 and the duration of frame 603 are substantially equal, in order to maintain the global DC balance for the driving cycle. In this driving cycle, the color of the pixel changes from white (in driving frames 601 and 604) to grey (in driving frame 605) and back to white (in driving frame 603) and finally remains white in the resting cycle. The transition through a grey state (in driving frame 605) allows refreshing of the pixel for image uniformity.

For a white pixel to change to the dark state in the next image (i.e., waveform II), the voltage is set to 0 throughout the driving cycle. As a result, the pixel turns to the dark state in the driving cycle and remains in the dark state in the resting cycle.

For a dark pixel to change to the white state (i.e., waveform III), the driving cycle has two driving frames, 606 (T1-T6) and 603 (T6-T7). The voltages for the two driving frames are set at +V and 0, respectively. The duration of frame 603 is substantially equal to the duration of driving frame 605, and the duration from T1 to T2 is substantially equal to the duration from T4 to T6 in order to maintain the global DC balance for the driving cycle. The dark pixel turns to white in the driving cycle and remains white in the resting cycle.

For a dark pixel to be maintained in the dark state in the next image (i.e., waveform IV), the driving cycle is divided into multiple driving frames, 607 (T1-T2), 608 (T2-T3), 609 (T3-T4), 610 (T4-T6) and 603 (T6-T7). The voltages applied to the driving frames 607, 608, 609, 610 and 603 are 0, +V, 0, +V and 0, respectively. The durations of frames 608 and 609 are substantially equal in order to maintain the global DC balance. The pixel, in this case, is transitioned through a grey state (in driving frame 608) which allows refreshing of the pixel. The durations of driving frame 608, 609, 603 and 605 depend on the properties of the display device. Generally, after applying the two driving signals, the optical density of the pixel should reach its optimal value.

It is noted that the division of the driving cycle (i.e., the locations of the driving frames) for the "white to white" and "dark to dark" pixels may vary to ensure high quality of the images, while the global DC balance for the driving cycle is maintained.

Figure 7:
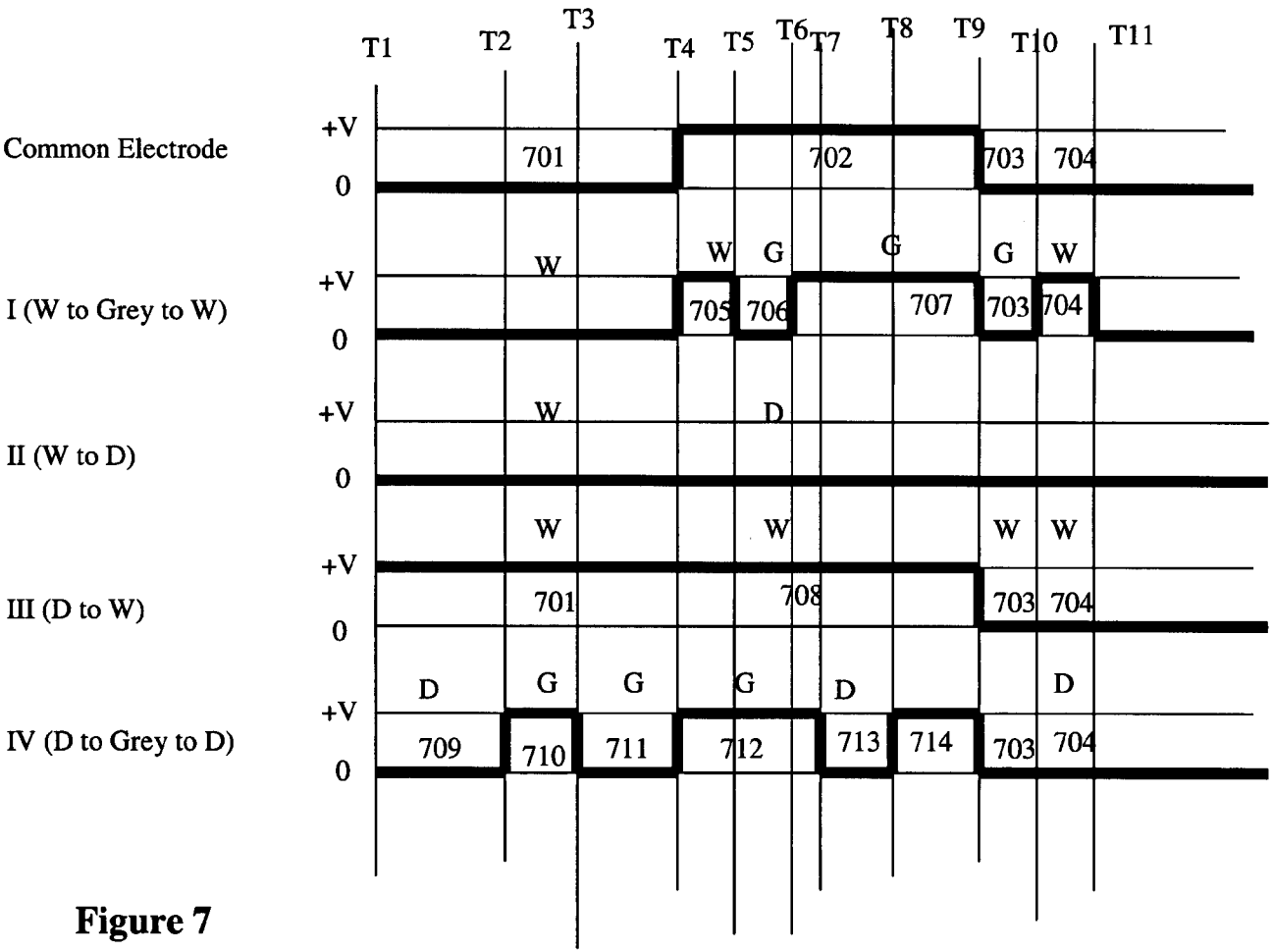

FIG. 7 illustrates another driving method, which incorporates the features of FIGS. 3 and 6, that is, a driving signal is applied in a first driving frame to pixels which remain in the same color state in consecutive images and the first short pulse causes the pixels to inverse their optical state insignificantly without drawing viewers' notice. Following the first driving frame, the driving signal is applied in a second driving frame having the same duration as the first driving frame to drive the pixels back to their original color state. This driving method ensures that the pixels get refreshed during transition between two images. The driving method as illustrated involves maintaining the global DC balance for each driving cycle.

The driving method as shown in FIG. 7 also comprises one driving cycle (T1-T11) and a resting cycle (from T11 to the start of the next driving cycle). The top wave form represents the voltages applied to the common electrode and the four waveforms, I, II, III and IV, represent how pixels in the display device may be driven from "white to white", "white to dark", "dark to white" and "dark to dark", respectively. The initial color, white or dark, of a pixel is the color of the pixel before the driving method is applied.

The voltage for the common electrode is set to 0 in driving frame 701 (T1-T4), set to +V in driving frame 702 (T4-T9) and set to 0 in driving frames 703 (T9-T10) and 704 (T10-T11).

For a white pixel to be maintained in the white state (i.e., waveform I), the driving cycle comprises four driving frames, 701 (T1-T4), 705 (T4-T5), 706 (T5-T6), 707 (T6-T9), 703 (T9-10) and 704 (T10-T11). The voltages for the driving frames 701, 705, 706, 707, 703 and 704 are set to 0, +V, 0, +V, 0 and +V respectively. In this driving cycle, the color of the pixel changes from white (in driving frame 701 and 705) to grey (in driving frames 706, 707 and 703) and back to white (in driving frame 704). The transition through a grey state (in driving frames 706, 707 and 703) and back to white (in frame 704) allows refreshing of the pixel for image uniformity.

For a white pixel to change to the dark state in the next image (i.e., waveform II), the voltage is set to 0 throughout the driving cycle. As a result, the pixel remains in the white state (T1-T4), turns to dark (T4-T11) and remains in the dark state in the resting cycle.

For a dark pixel to change to the white state in the next image (i.e., waveform III), the driving cycle has four driving frames, 701 (T1-T4), 708 (T4-T9), 703 (T9-T10) and 704 (T10-T11). The voltages for the four driving frames are set at +V, +V, 0 and 0, respectively. The dark pixel, in this case, turns to white in the driving cycle and remains white.

For a dark pixel to be maintained in the dark state in the next image (i.e., waveform IV), the driving cycle is divided into multiple driving frames, 709 (T1-T2), 710 (T2-T3), 711 (T3-T4), 712 (T4-T7), 713 (T7-T8), 714 (T8-T9), 703 (T9-T10) and 704 (T10-T11). The voltages applied during the driving frames 709, 710, 711, 712, 713, 714, 703 and 704 are 0, +V, 0, +V, 0, +V, 0 and 0 respectively. The pixel, in this case, is transitioned through a grey state (in driving frames 710-712) and back to the dark state in the driving frame 713, which allows refreshing of the pixel.

In this driving method, both the "white to white" and "dark to dark" pixels go through a transitional grey color state.

In the driving method as shown in FIG. 7, in order to maintain the global DC balance, (1) The duration of T1 to T4 is substantially equal to that of T4 to T9; (2) The duration of driving frame 710 is substantially equal to that of 713; and (3) The duration of driving frame 706 is substantially equal to that of frame 704 (T10-T11).

It is also noted that the division of the driving cycle (i.e., the locations of the driving frames) for the "white to white" and "dark to dark" pixels may vary to ensure high quality of the images, while the global DC balance for the driving cycle is maintained. For example, driving frame 710 (T2-T3) may move between T1 and T4; driving frame 713 (T7-T8) may move between T4 and T9; and driving frame 706 (T5-T6) may move between T4 and T9.

In addition, the duration of frames 703 (T9-T10), 705 (T4-T5), 707 (T6-T9), 711 (T3-T4) and 712 (T4-T7) may vary and can be zero.

Figure 8A:
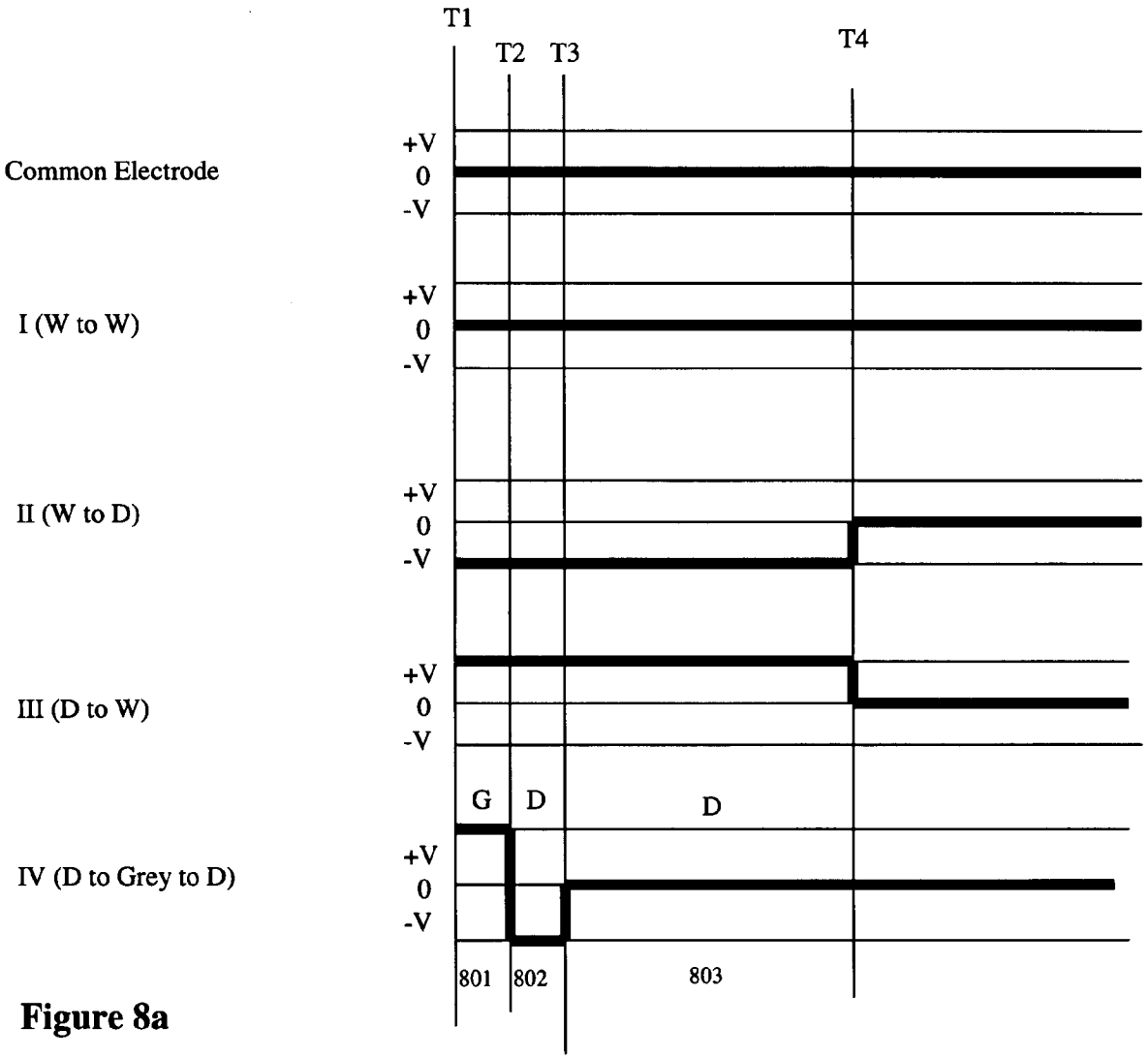
FIGS. 8*a* and 8*b* illustrate bipolar driving methods.
Figure 8B:
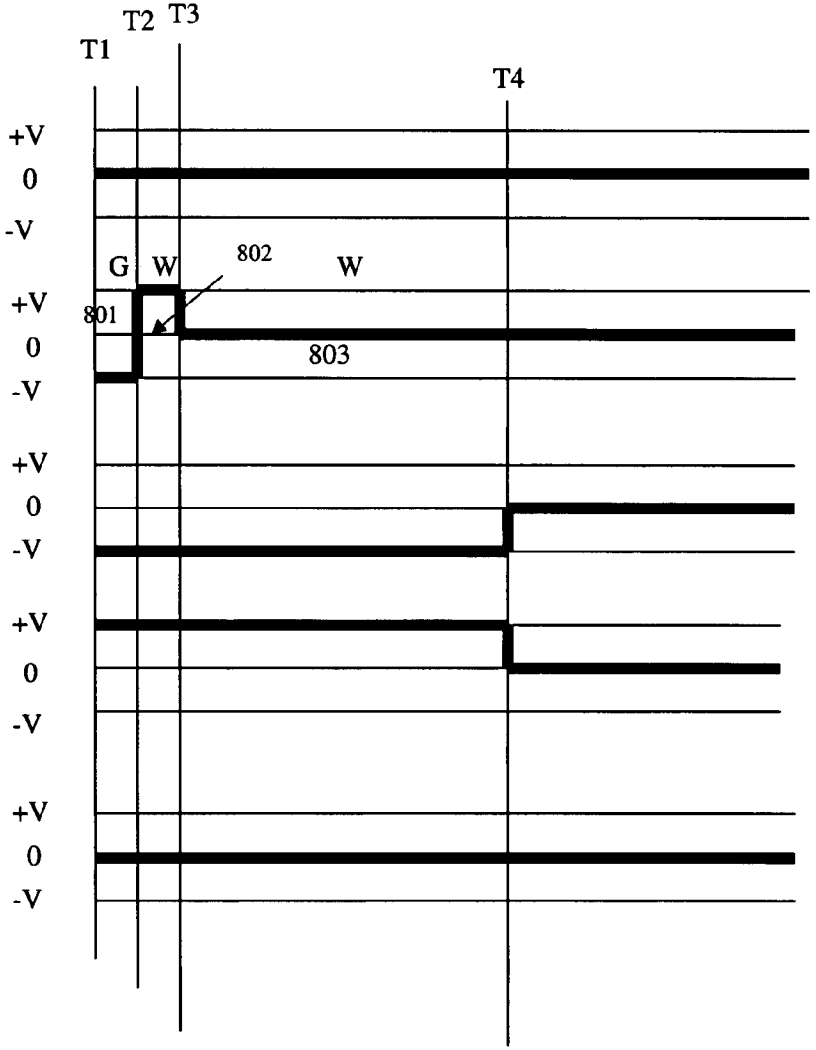

FIGS. 8*a* and 8*b* are the application of the methods as depicted in FIGS. 5*a* and 5*b* in the bipolar way, respectively. The driving method shown in FIG. 8*a* comprises one driving cycle (from T1 to T4) and a resting cycle (from T4 to the start of the next driving cycle). In the resting cycle, the display is not being driven (i.e., no voltage is applied). The top waveform represents the voltages applied to the common electrode. The four waveforms, I, II, III and IV, represent how pixels in the display device may be driven from "white to white", "white to dark", "dark to white" and "dark to dark", respectively. The initial color, white or dark, of a pixel is the color of the pixel before the driving method is applied.

The voltage for the common electrode is set to 0 throughout the driving cycle.

For a white pixel to be maintained in the white state (i.e., waveform I), the voltage is also set to 0 throughout the driving cycle. As a result, the white color is maintained.

For a white pixel to change to the dark state (i.e., waveform II), the voltage is set to −V throughout the driving cycle and switched to 0 when entering the resting cycle. In the driving cycle, the pixel turns to the dark state and remains in the dark state in the resting cycle.

For a dark pixel to change to the white state in the next image (i.e., waveform III), a voltage of +V is applied throughout the driving cycle and switched to 0 when entering the resting cycle. In the driving cycle, the pixel turns white and remains white in the resting cycles.

For a dark pixel to be maintained in the dark state in the next image (i.e., waveform IV), the driving cycle is divided into three driving frames, 801 (T1-T2), 802 (T2-T3) and 803 (T3-T4). In driving frame 801, the voltage is set to +V, switched to −V in driving frame 802 and raised to 0 in driving frame 803. The pixel turns to an intermediate color state in driving frame 801, returns to the dark state in driving frame 802 and remains in the dark state in driving frame 803.

In FIG. 8*b*, waveforms II and III are identical to those of FIG. 8*a*. For a white pixel to be maintained in the white state (i.e., waveform I) in FIG. 8*b*, the voltage is set at −V in driving frame 801, raised to +V in driving frame 802 and switched to 0 in driving frame 803. As a result, the white pixel goes through an intermediate color state in driving frame 801. For a dark pixel to be maintained in the dark state in the next image (i.e., waveform IV) in FIG. 8*b* the driving cycle is set to 0 throughout the driving cycle and the pixel remains in the dark color state in the driving cycle.

In the driving methods of FIGS. 8*a* and 8*b*, the duration of driving frame 801 and the duration of driving frame 802 are substantially equal in order to maintain the global DC balance.

Only the "dark to dark" pixels are shown in FIG. 8*a* to go through an intermediate color state and only the "white to white" pixels are shown in FIG. 8*b* to go through an intermediate color state. However, it is possible to adopt the waveform IV in FIG. 8*a* and waveform I in FIG. 8*b* in one driving method. In other words, such driving method would have both the "dark to dark" pixels and the "white to white" pixels going through an intermediate color state.

Figure 9A:
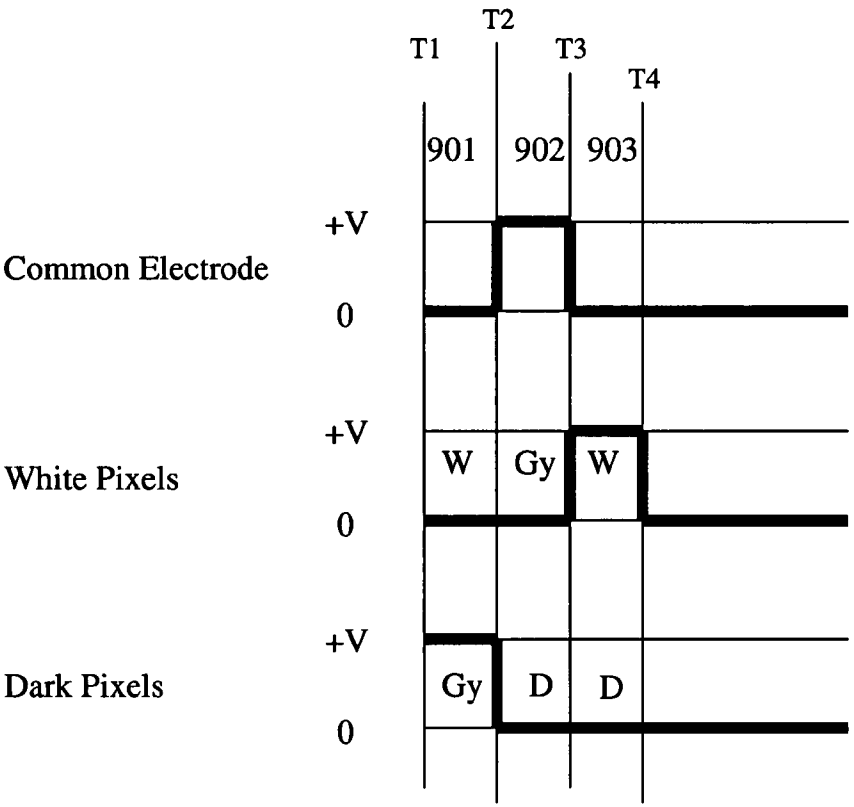
FIGS. 9*a* and 9*b* illustrate driving methods to enhance display images.
Figure 9B:
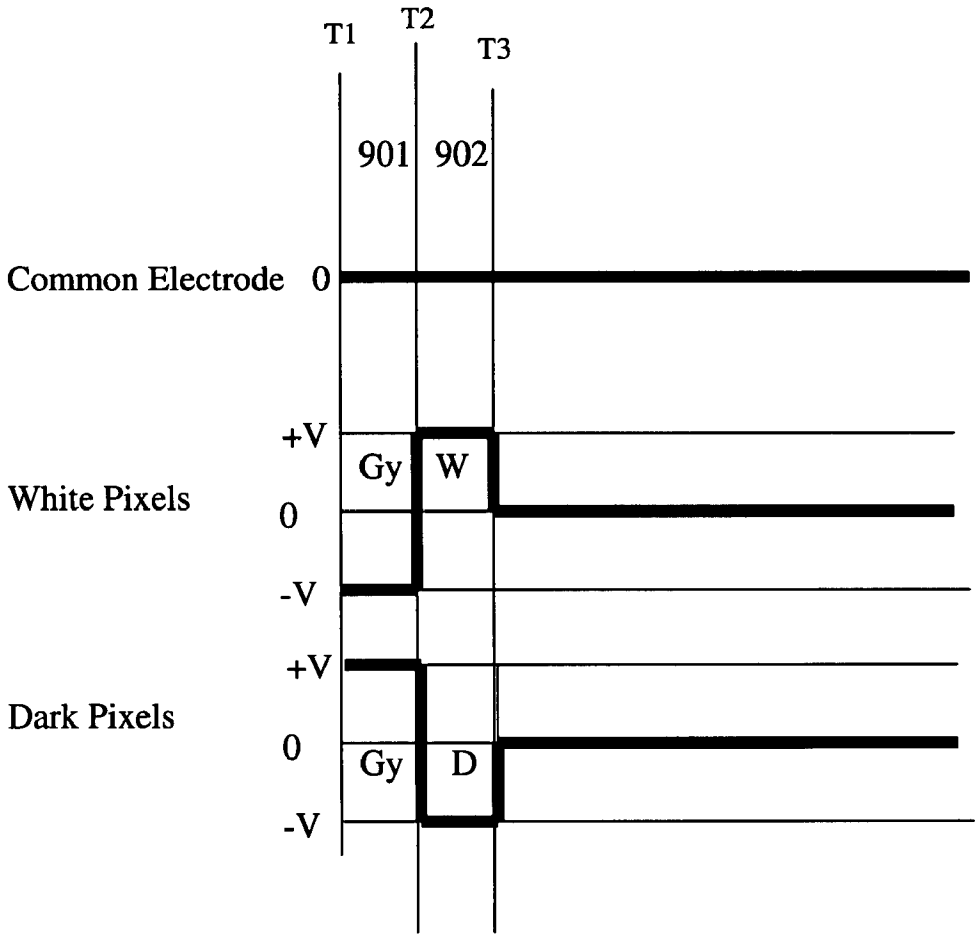

FIGS. 9*a* and 9*b* illustrate the application of the methods as depicted in FIGS. 5*a* and 5*b*, wherein pixels go through an intermediate color state while there is no change in the image displayed.

FIG. 9*a* illustrates a uni-polar driving method in which short pulses are applied to enhance images. In the method shown, pixels go through an intermediate color state, for example, white-grey-white or dark-grey-dark and in this case, there is no change of the image displayed.

As shown in FIG. 9*a*, the driving method comprises three driving frames, 901 (T1-T2), 902 (T2-T3) and 903 (T3-T4) and a resting cycle (T4 to the start of the next driving cycle).

The voltage for the common electrode is set to 0 in driving frame 901 (T1-T2), switched to +V in driving frame 902 (T2-T3) and lowered to 0 in driving frame 903 (T3-T4).

For the white pixels, the voltage is set to 0 in driving frames 901 and 902 and switched to +V in driving frame 903. The white pixels are in an intermediate color state (i.e., grey) in driving frame 902.

For the dark pixels, the voltage is set to +V in driving frame 901 and lowered to 0 in driving frames 902 and 903. The dark pixels are in an intermediate color state (i.e., grey) in driving frame 901.

In the driving method as shown in FIG. 9*a*, the durations of driving frames 901, 902 and 903 are substantially equal in order to maintain the global DC balance.

FIG. 9*b* illustrates a bipolar driving method in which driving signals are applied to enhance images. In the method shown, pixels also go through an intermediate color state while there is no change of the image displayed.

As shown in FIG. 9*b*, the driving method comprises two driving frames, 901 (T1-T2) and 902 (T2-T3) and a resting cycle (T3 to the start of the next driving cycle).

The voltage for the common electrode is set to 0 throughout.

For the white pixels, the voltage is set to −V in driving frames 901 and switched to +V in driving frame 902. The white pixels are in an intermediate color state (i.e., grey) in driving frame 901.

For the dark pixels, the voltage is set to +V in driving frame 901 and lowered to −V in driving frame 902. The dark pixels are in an intermediate color state (i.e., grey) in driving frame 901.

In the driving method as shown in FIG. 9*b*, the durations of driving frames 901 and 902 are substantially equal in order to maintain the global DC balance.

3.0 Extensions and Alternatives

Numerous applications may utilize the driving methods in one form or another. Some examples include, without limitation, electronic books, personal digital assistants, mobile computers, mobile phones, digital cameras, electronic price tags, digital clocks, smart cards, and electronic papers.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the improved driving scheme for an electrophoretic display. Accordingly, the present embodiments are to be considered as illustrative and not restrictive, and the invention is not to be limited to the details given herein, but may be modified.

What is claimed is:

1. A method, comprising:

applying, to a first class of pixels of a display that remain in one color state among two possible color states in both a first display image and a second display image, a driving signal in a first driving frame using a voltage and time duration only sufficient to cause the pixels to display, during a transition between the first and second display images, an intermediate color state having an optical density different than the two possible color states;

applying, to the first class of pixels, the driving signal in a second driving frame using a voltage and time duration sufficient to cause the pixels to display the one color state and to provide the second display image.

2. The method of claim 1, further comprising applying, to a second class of pixels, a third driving signal using a voltage and time duration sufficient to change the pixels in the second class from a first color state to a second color state without going through an intermediate color state.

3. The method of claim 1 wherein an average voltage applied across the display is substantially zero when integrated over a time period.

4. The method of claim 1 wherein a uni-polar approach is used for the first applying step.

5. The method of claim 1 wherein the first applying comprises: applying the driving signal in the first driving frame at ground potential for a first duration; applying the driving signal in one or more second driving frames at a positive voltage for a second duration that is shorter than the first duration; applying the driving signal in a third driving frame at ground potential for a third duration; applying the driving signal in a fourth driving frame at a positive voltage for a fourth duration.

6. The method of claim 5 wherein the third duration is shorter than the second duration.

7. The method of claim 1 wherein a bipolar approach is used for the first applying step.

8. The method of claim 1 wherein the applying steps each comprises applying the driving signal to pixels in display cells that are filled with an electrophoretic fluid comprising charged pigment particles dispersed in a solvent.

9. The method of claim 1 wherein the applying steps each comprises applying the driving signal to pixels in display cells that are filled with an electrophoretic fluid comprising charged pigment particles dispersed in a colored material capable of a colored state that is different than the color states of the charged pigment particles.

10. The method of claim 1 wherein the applying steps each comprises applying the driving signal to pixels in display cells that are filled with an electrophoretic fluid comprising two different types of charged particles having opposite charge polarities and different colors dispersed in a solvent.

11. The method of claim 1 wherein the first applying comprises applying, to a first class of pixels of a display that remain in one color state in both a first display image and a second display image, a driving signal using a voltage and time duration sufficient to cause the pixels to display during transition between the first and second display images an intermediate color state having a change in optical density as compared to the first display image of at least 0.03.

12. The method of claim 1 comprising applying the driving signal using 40 volts for 0.15 seconds to 0.40 seconds.

* * * * *